US005618652A

United States Patent [19]

Ueda et al.

[11] Patent Number: 5,618,652

[45] Date of Patent: Apr. 8, 1997

[54] IMAGE FORMATION METHOD BY SILVER SALT DIFFUSION TRANSFER

[75] Inventors: Shinji Ueda; Hisashi Okada; Kazumi Nii, all of Kanagawa, Japan

[73] Assignee: Fuji Photo Film Co., Ltd., Kanagawa, Japan

[21] Appl. No.: 615,464

[22] Filed: Mar. 14, 1996

[30] Foreign Application Priority Data

Mar. 22, 1995 [JP] Japan ..... 7-062634

[51] Int. Cl.[6] ..... G03C 8/36; G03C 8/06; G03C 5/305

[52] U.S. Cl. ..... 430/250; 430/233; 430/248; 430/436; 430/437; 430/480; 430/490

[58] Field of Search ..... 430/250, 248, 430/233, 480, 436, 437, 490

[56] References Cited

U.S. PATENT DOCUMENTS

| | | | |
|---|---|---|---|
| 2,843,481 | 7/1958 | Blout et al. | 96/29 |
| 3,619,185 | 11/1971 | Kasman | 96/29 |
| 3,740,221 | 6/1973 | Willems et al. | 430/250 |
| 3,806,345 | 4/1974 | Willems et al. | 430/250 |
| 4,514,488 | 4/1985 | Idota et al. | 430/250 |
| 5,100,765 | 3/1992 | Fujimoto et al. | 430/490 |
| 5,153,111 | 10/1992 | Yoshida et al. | 430/490 |
| 5,354,646 | 10/1994 | Kobayashi et al. | 430/490 |

FOREIGN PATENT DOCUMENTS

| | | | |
|---|---|---|---|
| 49-13580 | 4/1974 | Japan | G03C 5/26 |

*Primary Examiner*—Richard Schilling
*Attorney, Agent, or Firm*—Sughrue, Mion, Zinn, Macpeak & Seas

[57] ABSTRACT

An image formation method by silver salt diffusion transfer is described, which comprises subjecting a photosensitive element containing at least one photosensitive silver halide emulsion layer to image exposure, then developing the photosensitive element by use of an alkali processing composition containing a solvent for a silver halide to turn at least a part of unexposed silver halide of the photosensitive silver halide emulsion layer into a transferable silver complex salt, transferring at least a part of the transferable complex salt to a silver precipitating nucleus-containing image receiving layer to form an image on the silver precipitating nucleus-containing image receiving layer, and separating the silver precipitating nucleus-containing image receiving layer from the photosensitive element after image formation to obtain the image, wherein the image is formed in the presence of at least one compound represented by the following formula (I) and at least one compound represented by the following formula (II):

(I)

wherein R represents a hydrogen atom, an unsubstituted alkyl group, an unsubstituted alkenyl group or $-L_2-A_2$; $L_1$ and $L_2$ each represents an alkylene group; $A_1$ and $A_2$ each represents a carboxyl group, a sulfo group, a phosphono group, phosphinic acid group, an alkoxycarbonyl group, an aryloxycarbonyl group, a carbamoyl group, an acylamino group, a sulfamoyl group, a sulfonylamino group, an alkylthio group, a cyano group, a ureido group or an ammonio group, (II)

wherein $R_1$ represents an aryl group; and $R_2$, $R_3$, $R_4$ and $R_5$ each represents a hydrogen atom, an alkyl group, an aryl group, an alkoxyl group or an aryloxy group.

2 Claims, No Drawings

IMAGE FORMATION METHOD BY SILVER SALT DIFFUSION TRANSFER

FIELD OF THE INVENTION

The present invention relates to an image formation method by silver salt diffusion transfer, and a film unit used therein.

BACKGROUND OF THE INVENTION

At present, the diffusion transfer processes are well known in the art, and details thereof are described in A. Rott and E. Weyde, *Photographic Silver Halide Diffusion Process*, Focal Press, London (1972); J. Stutge, V. Walworth and A. Shepp, *Imaging Processes and Materials: Neblette's Eighth Edition*, Chapter 6, Instant Photography and Related Reprographic Processes, Van Nostrand Reinhold (1989); and G. Haist, *Modern Photographic Processing*, Vol. 2, Chapter 8, Diffusion Transfer, John Wiley and Sons (1979).

According to these diffusion transfer processes, many kinds of photographic materials can be prepared. As an example, a photosensitive element in which a silver halide emulsion is applied to a support and an image receiving element in which an image receiving layer containing silver precipitating nuclei is applied to another support are superimposed on each other, and an alkali processing composition which is a processing element, such as a high viscosity or low viscosity alkaline processing composition containing a developing agent and a solvent for a silver halide, is developed between the above-described two elements, whereby a transferred image can be obtained.

In the silver salt diffusion transfer processes, acquisition of transferred images for a shorter period of time has recently become an important problem for simplifying handling. For solving this problem, it is a primary subject to accelerate developing reaction in a photosensitive element and an image receiving sheet.

Use of hydroxylamine compounds as developing agents has been known in the silver salt diffusion transfer processes. Such hydroxylamine compounds are described in U.S. Pat. Nos. 2,843,481, 2,857,274, 2,857,275, 2,857,276, 3,287,124, 3,287,125, 3,293,034, 3,362,961, 3,455,916, 3,467,711 and 3,619,185, JP-B-48-30499 (the term "JP-B" as used herein means an "examined Japanese patent publication"), JP-A-48-43937 (the term "JP-A" as used herein means an "unexamined published Japanese patent application"), JP-A-49-88521, etc. These hydroxylamine compounds have the advantage that colored matter is difficult to be formed when they remain in prints, but are low in developing speed, resulting in insufficiency for completing developing reaction for a shorter period of time. For this reason, in order to increase the developing speed, use of 3-pyrazolidinone compounds in combination with the above-mentioned hydroxylamine compounds is described in JP-B-49-13580, etc. It is described in many literatures of photochemistry that use of the 3-pyrazolidinone compounds as superadditive developing agents (or supplementary developing agents) in combination with other developing agents increases the developing speed. This is also a very effective means in the silver salt diffusion transfer processes. However, studies conducted by the present inventors have proved that the 3-pyrazolidinone compounds have the disadvantage that when they remain in prints, oxidation intermediates thereof oxidize silver images, thereby fading the silver images. That is, the 3-pyrazolidinone compounds show the different behavior from that of the above-mentioned hydroxylamine compounds. Further, the disadvantage is also known that coloring of the oxidation intermediates themselves causes stains. In the silver salt diffusion transfer processes in which the processing solution compositions are developed between the photosensitive elements and the image receiving elements, followed by separation of the image receiving elements to obtain prints of silver images, the 3-pyrazolidinone compounds naturally remain in the prints and the oxidation intermediates are formed by air oxidation. As a result, in the silver salt diffusion transfer processes using the processing compositions containing the 3-pyrazolidinone compounds, the problem has been revealed that the silver images are particularly liable to fade, and it has become an important subject to solve this problem.

SUMMARY OF THE INVENTION

It is an object of the present invention to provide a silver salt diffusion transfer process which gives a stable silver image reduced in fading, while accelerating developing reaction using a 3-pyrazolidinone compound.

The present inventors have further studied to achieve the above-mentioned object. As a result, the present inventors have discovered that the above-mentioned problem can be solved by conducting the above-mentioned silver salt diffusion transfer process in the presence of 3-pyrazolidinone compounds and specified hydroxylamine compounds. Previously, hydroxylamine compounds and 3-pyrazolidinone compounds have been used as developing agents in the silver salt diffusion transfer processes. For these hydroxylamine compounds for developing agents, however, the effect of stabilizing silver images is not observed. In contrast, the hydroxylamine compounds of the present invention show the effect of stabilizing silver images, when they are used in combination with the 3-pyrazolidinone compounds.

The hydroxylamine compounds of the present invention and the hydroxylamine compounds previously known as developing agents for the silver salt diffusion transfer processes are all described as preservatives of color developers for silver halide color photographic materials in many patents. However, it is neither described nor suggested in any known literatures that the hydroxylamine compounds of the present invention can prevent oxidation and fading of silver images due to oxides of the 3-pyrazolidinone compounds. This can not therefore be presumed at all.

That is, such an object of the present invention has been achieved by (1) an image formation method by silver salt diffusion transfer comprising subjecting a photosensitive element containing at least one photosensitive silver halide emulsion layer to image exposure, then developing the photosensitive element by use of an alkali processing composition containing a solvent for a silver halide to turn at least a part of unexposed silver halide of the photosensitive silver halide emulsion layer into a transferable silver complex salt, transferring at least a part of the transferable complex salt to a silver precipitating nucleus-containing image receiving layer to form an image on the silver precipitating nucleus-containing image receiving layer, and separating the silver precipitating nucleus-containing image receiving layer from the photosensitive element after image formation to obtain the image, wherein the image is formed in the presence of at least one compound represented by the following formula (I) and at least one compound represented by the following formula (II):

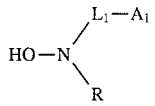

(I)

wherein R represents a hydrogen atom, an unsubstituted alkyl group, an unsubstituted alkenyl group or $-L_2-A_2$; $L_1$ and $L_2$ each represents an alkylene group; $A_1$ and $A_2$ each represents a carboxyl group, a sulfo group, a phosphono group, phosphinic acid group, an alkoxycarbonyl group, an aryloxycarbonyl group, a carbamoyl group, an acylamino group, a sulfamoyl group, a sulfonylamino group, an alkylthio group, a cyano group, a ureido group or an ammonio group,

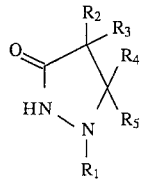

(II)

wherein $R_1$ represents an aryl group; and $R_2$, $R_3$, $R_4$ and $R_5$ each represents a hydrogen atom, an alkyl group, an aryl group, an alkoxyl group or an aryloxy group; and (2) the image formation method described in (1), wherein a compound represented by the following formula (III) is used as a developing agent contained in the processing composition:

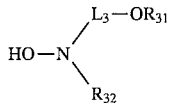

(III)

wherein $L_3$ represents an alkylene group; $R_{31}$ represents an alkyl group, an alkenyl group or an aryl group; and $R_{32}$ represents a hydrogen atom, an alkyl group or an alkenyl group.

DETAILED DESCRIPTION OF THE INVENTION

The compounds represented by formula (I) in the present invention are hereinafter described in detail.

The unsubstituted alkyl group represented by R may be straight, branched or cyclic, and has preferably 1 to 10 carbon atoms, more preferably 1 to 6 carbon atoms, still more preferably 1 to 4 carbon atoms. A straight chain alkyl group having 1 to 4 carbon atoms is particularly preferred. Examples of the unsubstituted alkyl groups represented by R include methyl, ethyl, n-propyl, iso-propyl, n-butyl, tertbutyl, n-hexyl and cyclohexyl. The unsubstituted alkenyl group represented by R may be straight, branched or cyclic, and has preferably 2 to 10 carbon atoms, more preferably 2 to 6 carbon atoms, still more preferably 2 to 4 carbon atoms. A straight chain alkenyl group having 2 to 4 carbon atoms is particularly preferred. Examples of the alkenyl groups represented by R include allyl, 2-butenyl and 2-pentenyl. R is preferably a hydrogen atom or $-L_2-A_2$, more preferably $-L_2-A_2$.

The alkylene groups represented by $L_1$ and $L_2$ may be the same or different, and may be straight chain, branched or cyclic. They may have substituent groups, which include, for example, aryl groups (having preferably 6 to 12 carbon atoms, more preferably 6 to 10 carbon atoms, particularly preferably 6 to 8 carbon atoms, and including, for example, phenyl and p-methylphenyl), alkoxyl groups (having preferably 1 to 8 carbon atoms, more preferably 1 to 6 carbon atoms, particularly preferably 1 to 4 carbon atoms, and including, for example, methoxy and ethoxy), aryloxy groups (having preferably 6 to 12 carbon atoms, more preferably 6 to 10 carbon atoms, particularly preferably 6 to 8 carbon atoms, and including, for example, phenyloxy), acyl groups (having preferably 2 to 12 carbon atoms, more preferably 2 to 10 carbon atoms, particularly preferably 2 to 8 carbon atoms, and including, for example, acetyl), alkoxycarbonyl groups (having preferably 2 to 12 carbon atoms, more preferably 2 to 10 carbon atoms, particularly preferably 2 to 8 carbon atoms, and including, for example, methoxycarbonyl), acyloxy groups (having preferably 2 to 12 carbon atoms, more preferably 2 to 10 carbon atoms, particularly preferably 2 to 8 carbon atoms, and including, for example, acetoxy), acylamino groups (having preferably 2 to 10 carbon atoms, more preferably 2 to carbon atoms, particularly preferably 2 to 4 carbon atoms, and including, for example, acetylamino), sulfonylamino groups (having preferably 1 to 10 carbon atoms, more preferably 1 to 6 carbon atoms, particularly preferably 1 to 4 carbon atoms, and including, for example, methanesulfonylamino), sulfamoyl groups (having preferably 0 to 10 carbon atoms, more preferably 0 to 6 carbon atoms, particularly preferably 0 to 4 carbon atoms, and including, for example, sulfamoyl and methylsulfamoyl), carbamoyl groups (having preferably 1 to 10 carbon atoms, more preferably 1 to 6 carbon atoms, particularly preferably 1 to 4 carbon atoms, and including, for example, carbamoyl and methylcarbamoyl), alkylthio groups (having preferably 1 to 8 carbon atoms, more preferably 1 to 6 carbon atoms, particularly preferably 1 to 4 carbon atoms, and including, for example, methylthio and ethylthio), sulfonyl groups (having preferably 1 to 8 carbon atoms, more preferably 1 to 6 carbon atoms, particularly preferably 1 to 4 carbon atoms, and including, for example, methanesulfonyl), sulfinyl groups (having preferably 1 to 8 carbon atoms, more preferably 1 to 6 carbon atoms, particularly preferably 1 to 4 carbon atoms, and including, for example, methanesulfinyl), a hydroxyl group, halogen atoms (for example, fluorine, chlorine, bromine and iodine), a cyano group, a sulfo group, a carboxyl group, a nitro group and heterocyclic groups (for example, imidazolyl and pyridyl). These substituent groups may be further substituted. When there are two or more substituent groups, they may be the same or different. Preferred examples of the substituent groups include alkoxyl groups, a carboxyl group, a hydroxyl group, halogen atoms, a cyano group and a nitro group, and more preferred examples include alkoxyl groups, a carboxyl group and a hydroxyl group. The alkylene groups represented by $L_1$ and $L_2$ are alkylene groups each having preferably 1 to 6 carbon atoms, more preferably 1 to 4 carbon atoms, still more preferably 1 and 2 carbon atoms. Examples of the alkylene groups include methylene, ethylene, propylene and methylmethylene. Methylene and ethylene are more preferred, and ethylene is particularly preferred. Further, R and $L_1$ may combine to form a ring.

The alkoxycarbonyl groups represented by $A_1$ and $A_2$ are alkoxycarbonyl groups each having preferably 2 to 12 carbon atoms, more preferably 2 to 10 carbon atoms, particularly preferably 2 to 8 carbon atoms, and examples thereof include methoxycarbonyl, ethoxycarbonyl, n-propoxycarbonyl and n-butoxycarbonyl. The aryloxycarbonyl groups represented by $A_1$ and $A_2$ are aryloxycarbonyl groups each having preferably 7 to 14 carbon atoms, more preferably 7 to 11 carbon atoms, particularly preferably 7 and 8 carbon atoms, and examples thereof include phenoxycarbonyl and 4-methylphenoxycarbonyl. The carbamoyl groups represented by $A_1$ and $A_2$ are carbamoyl groups each having preferably 1 to 10 carbon atoms, more preferably 1 to 6 carbon atoms, particularly preferably 1 to 4 carbon atoms, and examples thereof include carbamoyl and methylcarbamoyl. The acylamino groups represented by $A_1$ and $A_2$ are acylamino groups each having preferably 2 to 10 carbon atoms, more preferably 2 to 6 carbon atoms, particularly preferably 2 to 4 carbon atoms, and examples thereof include acetylamino. The sulfamoyl groups represented by $A_1$ and $A_2$ are sulfamoyl groups each having preferably 0 to 10 carbon atoms, more preferably 0 to 6 carbon atoms, particularly preferably 0 to 4 carbon atoms, and examples thereof include sulfamoyl and methylsulfamoyl. The sulfonylamino groups represented by $A_1$ and $A_2$ are sulfonylamino groups each having preferably 1 to 10 carbon atoms, more preferably 1 to 6 carbon atoms, particularly preferably 1 to 4 carbon atoms, and examples thereof include methanesulfonylamino. The alkylthio groups represented by $A_1$ and $A_2$ are alkylthio groups each having preferably 1 to 8 carbon atoms, more preferably 1 to 6 carbon atoms, particularly preferably 1 to 4 carbon atoms, and examples thereof include methylthio and ethylthio. The ureido groups represented by $A_1$ and $A_2$ are ureido groups each having preferably 1 to 10 carbon atoms, more preferably 1 to 6 carbon atoms, particularly preferably 1 to 4 carbon atoms, and examples thereof include ureido and methylureido. The ammonio groups represented by $A_1$ and $A_2$ are ammonio groups each having preferably 3 to 12 carbon atoms, more preferably 3 to 9 carbon atoms, particularly preferably 3 to 6 carbon atoms, and examples thereof include trimethylammonio. $A_1$ and $A_2$ are preferably carboxyl groups, sulfo groups, phosphono groups, phosphinic acid groups, alkoxycarbonyl groups or aryloxycarbonyl groups, more preferably carboxyl groups, sulfo groups, phosphono groups or alkoxycarbonyl groups, and still more preferably carboxyl groups or alkoxycarbonyl groups. Carboxyl groups are particularly preferred.

Of the compounds represented by formula (I), a compound represented by formula (I-a) is preferred.

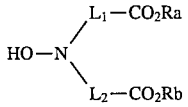

(I-a)

wherein $L_1$ and $L_2$ each has the same meaning as defined in formula (I), and preferred examples thereof are similar to those of formula (I); and Ra and Rb represent hydrogen atoms, alkyl groups or cations.

The alkyl groups represented by Ra and Rb are alkyl groups each having preferably 1 to 11 carbon atoms, more preferably 1 to 9 carbon atoms, particularly preferably 1 to 7 carbon atoms, and examples thereof include methyl, ethyl, n-propyl or n-butyl. The cations represented by Ra and Rb indicate organic or inorganic cations, and examples thereof include alkali metals ($Li^+$, $Na^+$, $K^+$, $Cs^+$, etc.), alkaline earth metals ($Mg^{2+}$, $Ca^{2+}$, etc.), ammonium (ammonium, trimethylammonium, triethylammonium, tetramethylammonium, tetraethylammonium, tetrabutylammonium, 1,2-ethanediammonium, etc.), pyridinium and phosphonium (tetrabutylphosphonium, etc.). Ra and Rb are preferably hydrogen atoms or cations.

Specific examples of the compounds represented by formula (I) are shown below, but the present invention is not limited thereto.

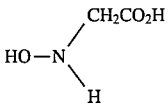

I-1.

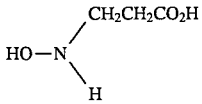

I-2.

-continued

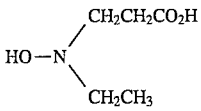

I-3.

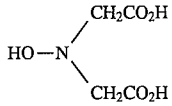

I-4.

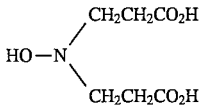

I-5.

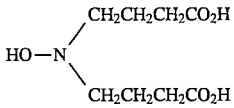

I-6.

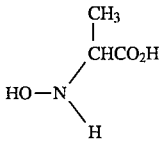

I-7.

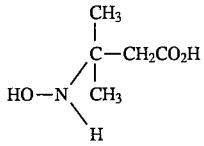

I-8.

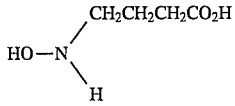

I-9.

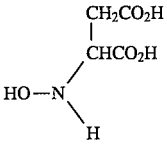

I-10.

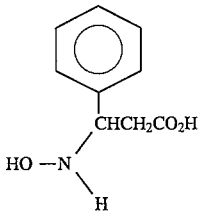

I-11.

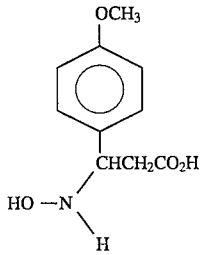

I-12.

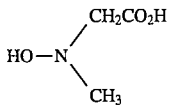

I-13.

-continued
I-14.
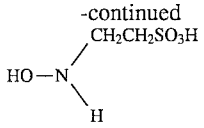
I-15.
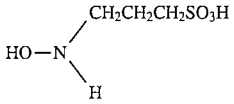
I-16.
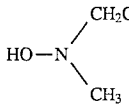
I-17.
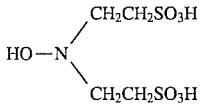
I-18.
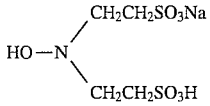
I-19.
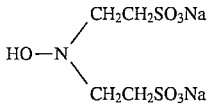
I-20.
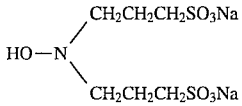
I-21.
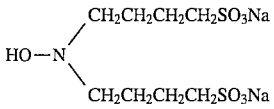
I-22.
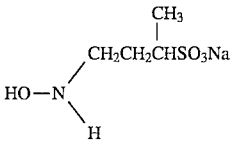
I-23.
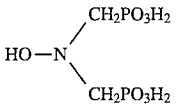
I-24.
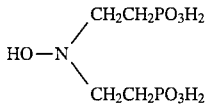
I-25.
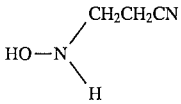
I-26.
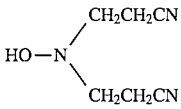
I-27.
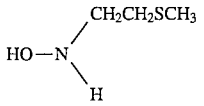
-continued
I-28.
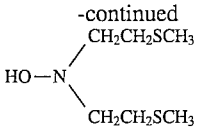
I-29.
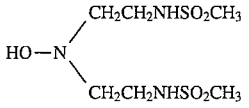
I-30.
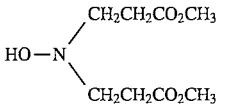
I-31.
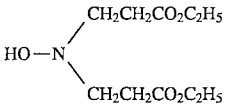
I-32.
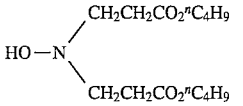
I-33.
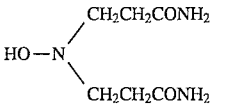
I-34.
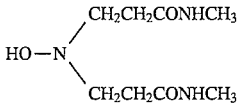
I-35.
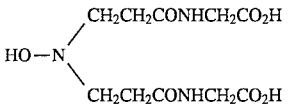
I-36.
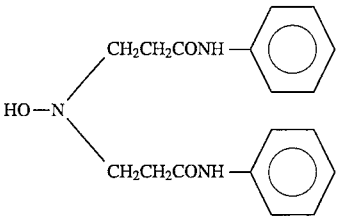
I-37.
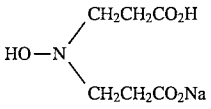
I-38.
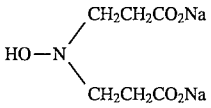
I-39.
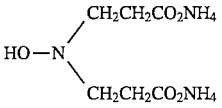
I-40.
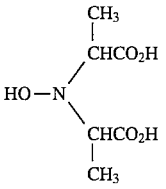

-continued
I-41.
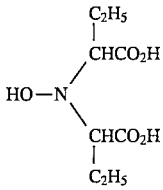
I-42.
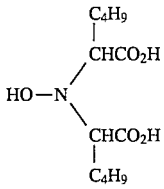
I-43.
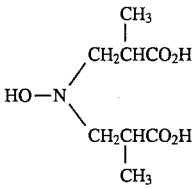
I-44.
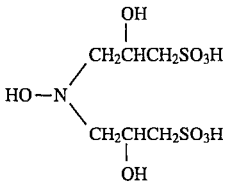
I-45.
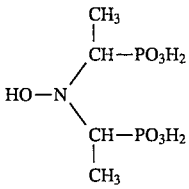
I-46.
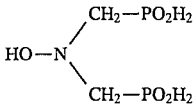
I-47.
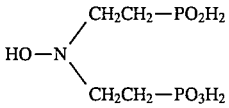
I-48.
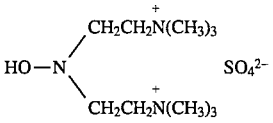
I-49.
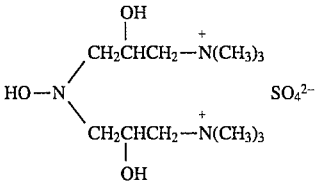
I-50.
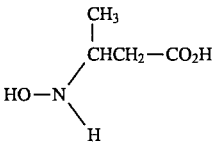
-continued
I-51.
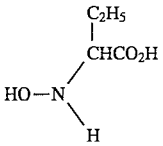
I-52.
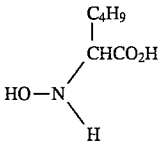
I-53.
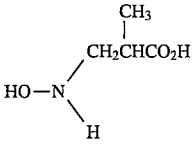
I-54.
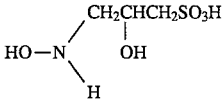
I-55.
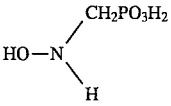
I-56.
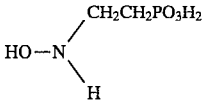
I-57.
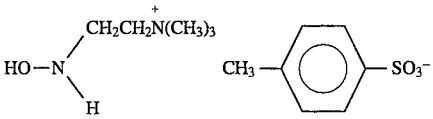
I-58.
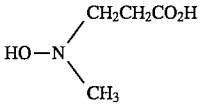
I-59.
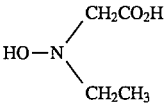
I-60.
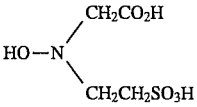
I-61.
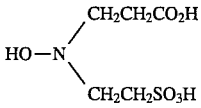
I-62.
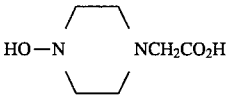
I-63.
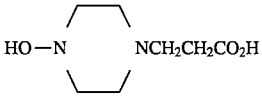

-continued

I-64.

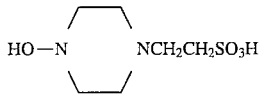

I-65.

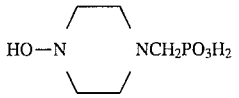

I-66.

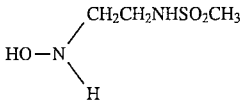

I-67.

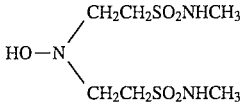

I-68.

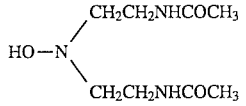

I-69.

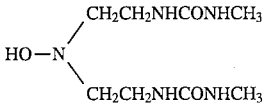

I-70.

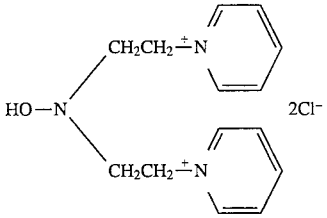

I-71.

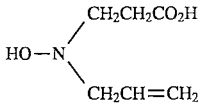

I-72.

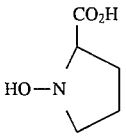

The compounds represented by formula (I) can be synthesized by subjecting commercial hydroxylamine compounds to alkylation reaction (nucleophilic displacement reaction, addition reaction or Mannich reaction). That is, they can be synthesized based on the methods described in West German Patent 1,159,634, *Inorganica Chimica Acta*, vol. 93, pages 101 to 108 (1984), etc. Specific methods are described below:

SYNTHESIS EXAMPLE 1

Example compound (I-5) was synthesized according to the following reaction formula:

Synthesis of (I-5)

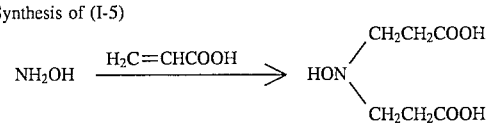

(I-5)

Synthesis of (I-5)

To 1.5 liter of methanol, 330 g of a 50% aqueous solution of hydroxylamine was added, and the mixture was stirred. Then, 685 g of acrylic acid was added dropwise thereto for 30 minutes. The reaction solution generated heat simultaneously with dropping, and was refluxed. After termination of dropping, the solution was further refluxed with heating for 30 minutes. After termination of reaction, the reaction solution was allowed to stand overnight for cooling, and the deposited crystals were taken by filtration. The resulting crystals were washed with methanol, and dried under reduced pressure to obtain 680 g of example compound (I-5).

Yield: 81%, decomposition point: 140° to 141° C.

SYNTHESIS EXAMPLE 2

Example compound (I-20) was synthesized according to the following reaction formula:

Synthesis of (I-20)

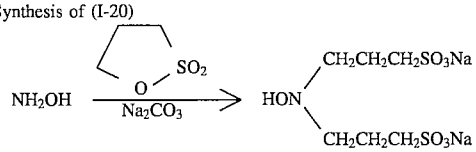

(I-20)

Synthesis of (I-20)

To 33 g of a 50% aqueous solution of hydroxylamine cooled with ice and stirred, 134 g of propanesultone was added dropwise at 30° C. or less. A solution obtained by dissolving 27 g of sodium carbonate in 100 ml of water was further added dropwise thereto, and the mixed solution was stirred at room temperature for 2 hours after termination of dropping. After termination of reaction, water was removed by distillation under reduced pressure. Then, 300 ml of methanol was added to the resulting crystals, followed by heating reflux. The resulting product was allowed to cool, and the deposited crystals were taken by filtration. The resulting crystals were recrystallized from 1 liter of methanol to obtain 70 g of example compound (I-20).

Yield: 43%, decomposition point: 245° to 247° C.

SYNTHESIS EXAMPLE 3

Example compound (I-15) of the present invention was synthesized according to the following reaction formula by the synthesis method described in *Tetrahedron Letter*, vol. 28, pages 2993 to 2994;

Synthesis of (I-15)

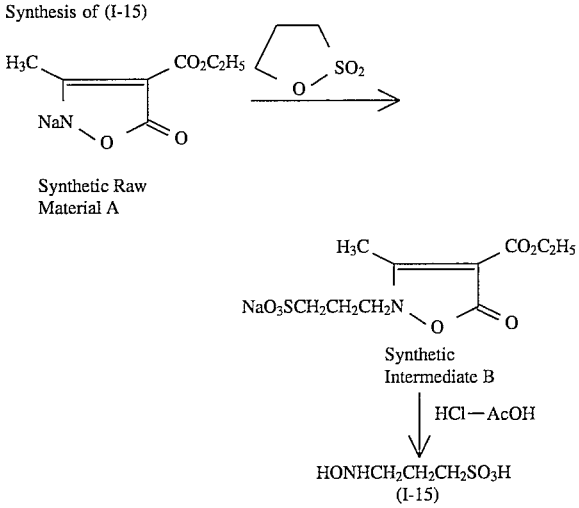

Synthesis of Reaction Intermediate B

A solution obtained by dissolving 58 g of synthetic raw material A synthesized according to the synthesis method described in the above-mentioned literature and 71 g of propanesultone in 300 ml of acetonitrile was refluxed with heating to be allowed to react for 8 hours. After termination of reaction, the reaction solution was cooled to 5° C. and the deposited crystals were taken by filtration. The resulting crystals were washed with acetonitrile and ethanol, and dried under reduced pressure to obtain 53 g of synthetic intermediate B.

Synthesis of (I-15)

To 31.5 g of synthetic intermediate B, 100 ml of concentrated hydrochloric acid and 60 ml of acetic acid were added, followed by heating reflux for 8 hours. After termination of reaction, the solvent was removed by distillation under reduced pressure, and aqueous ammonia was added to adjust the pH to 5 to 6, followed by concentration and evaporation to dryness. Concentrated hydrochloric acid was added to the resulting tar substance, and the deposited crystals were removed by filtration. The filtrate was concentrated. Concentrated hydrochloric acid was further added thereto, the deposited crystals were removed by filtration, and the filtrate was concentrated. Methanol was added to the resulting tar substance, followed by stirring. The deposited crystals were washed with methanol, and dried under reduced pressure to obtain 9.7 g of example compound (I-5).

Yield: 63%, decomposition point: 178° to 180° C.

The compounds represented by formula (II) in the present invention are hereinafter described in detail.

The aryl groups represented by $R_1$, $R_2$, $R_3$, $R_4$ and $R_5$ are preferably monocyclic or bicyclic, and examples thereof include phenyl and naphthyl. The aryl groups represented by $R_1$, $R_2$, $R_3$, $R_4$ and $R_5$ may have substituent groups, which include, for example, alkyl groups (having preferably 1 to 12 carbon atoms, more preferably 1 to 8 carbon atoms, particularly preferably 1 to 4 carbon atoms, and including, for example, methyl and ethyl), alkenyl groups (having preferably 2 to 12 carbon atoms, more preferably 2 to 8 carbon atoms, particularly preferably 2 to 4 carbon atoms, and including, for example, vinyl and aryl) and alkynyl groups (having preferably 2 to 12 carbon atoms, more preferably 2 to 8 carbon atoms, particularly preferably 2 to 4 carbon atoms, and including, for example, propargyl), as well as the substituent groups mentioned as those for $L_1$ in formula (I). The aryl groups represented by $R_1$, $R_2$, $R_3$, $R_4$ and $R_5$ are preferably unsubstituted phenyl and alkyl-substituted phenyl (for example, 4-methylphenyl), and more preferably unsubstituted phenyl.

The alkyl groups represented by $R_2$, $R_3$, $R_4$ and $R_5$ are straight chain, branched or cyclic alkyl groups, and the alkyl groups have preferably 1 to 12 carbon atoms, more preferably 1 to 6 carbon atoms, particularly preferably 1 to 4 carbon atoms. The alkyl groups represented by $R_2$, $R_3$, $R_4$ and $R_5$ may have substituent groups. As the substituent groups, for example, the substituent groups mentioned as those for $L_1$ in formula (I) can be applied. The preferred substituent group is a hydroxyl group. Examples of the alkyl groups represented by $R_2$, $R_3$, $R_4$ and $R_5$ include methyl, ethyl, hydroxymethyl and hydroxyethyl. The alkoxyl groups represented by $R_2$, $R_3$, $R_4$ and $R_5$ are alkoxyl groups having preferably 1 to 8 carbon atoms, more preferably 1 to 6 carbon atoms, particularly preferably 1 to 4 carbon atoms, and examples thereof include methoxy and ethoxy. The aryloxy groups represented by $R_2$, $R_3$, $R_4$ and $R_5$ are aryloxy groups having preferably 6 to 12 carbon atoms, more preferably 6 to 10 carbon atoms, particularly preferably 6 to 8 carbon atoms, and examples thereof include phenyloxy.

$R_2$ and $R_3$ are preferably hydrogen atoms, unsubstituted alkyl groups or hydroxyalkyl groups, and more preferably hydrogen atoms, methyl or hydroxymethyl. $R_4$ and $R_5$ are preferably hydrogen atoms or alkyl groups, and more preferably hydrogen atoms. As $R_2$, $R_3$, $R_4$ and $R_5$, it is particularly preferred that $R_2$ is methyl, $R_3$ is hydroxymethyl, and $R_4$ and $R_5$ are hydrogen.

Specific examples of the compounds represented by formula (II) are shown below, but the present invention is not limited thereto.

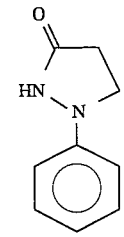

II-1

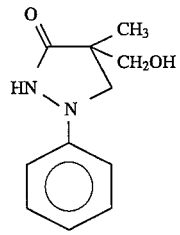

II-2

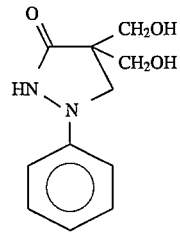

II-3

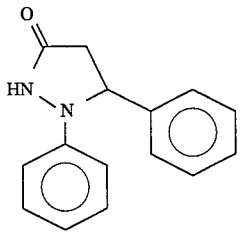

II-4

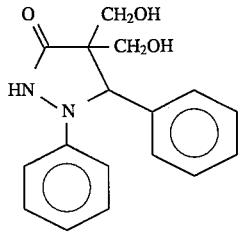

II-5

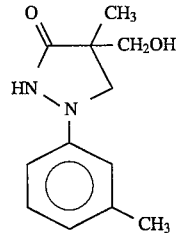

II-6

-continued

II-7

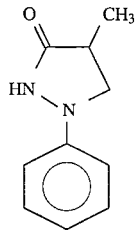

II-8

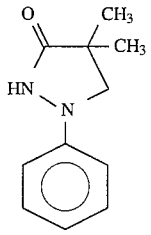

II-9

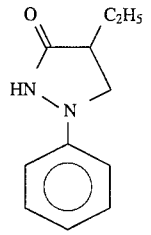

II-10

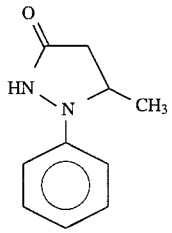

II-11

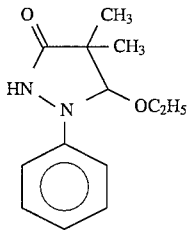

II-12

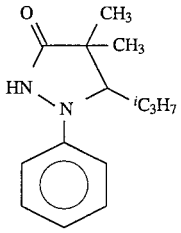

II-13

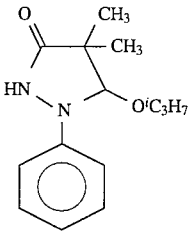

-continued

II-14

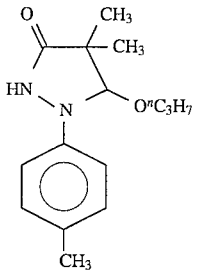

II-15

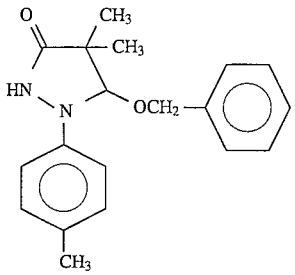

The compounds represented by formula (II) of the present invention can be synthesized by known methods, for example, the methods described in U.S. Pat. Nos. 3,330,839 and 2,772,282.

The compounds represented by formula (I) and the compounds represented by formula (II) of the present invention are preferably added to the processing composition to use them. However, each of the compounds may be allowed to exist to use it in the photosensitive element and/or the image receiving element. For example, both can also be allowed to exist in the separate members to use them, in such a way that the compounds represented by formula (II) are added to the processing solution composition and the compounds represented by formula (I) are allowed to exist in the image receiving element.

When the compound represented by formula (I) of the present invention is added to the processing solution composition, the amount added is preferably $5\times10^{-5}$ mol to 1 mol, more preferably $5\times10^{-4}$ mol to $1\times10^{-1}$ mol, per liter of processing composition. When the compound represented by formula (II) of the present invention is added to the processing solution composition, the amount added is preferably $5\times10^{-6}$ mol to $1\times10^{-1}$ mol, more preferably $5\times10^{-5}$ mol to $1\times10^{-2}$ mol, per liter of processing composition.

When the compound represented by formula (I) of the present invention is added to the photosensitive element, it may be added to any layer of the photosensitive element. The amount added is preferably $1\times10^{-5}$ to 0.5 mol, more preferably $1\times10^{-4}$ to $5\times10^{-2}$ mol, per square meter of photosensitive element. When the compound represented by formula (II) of the present invention is added to the photosensitive element, it may be added to any layer of the photosensitive element. The amount added is preferably $1\times10^{-6}$ to $5\times10^{-2}$ mol, more preferably $1\times10^{-5}$ to $5\times10^{-3}$ mol, per square meter of photosensitive element.

When the compound represented by formula (I) of the present invention is added to the image receiving element, it may be added to any layer of the image receiving element. The amount added is preferably $1\times10^{-7}$ to 0.5 mol, more preferably $1\times10^{-6}$ to $5\times10^{-2}$ mol, per square meter of image receiving element. When the compound represented by formula (II) of the present invention is added to the image receiving element, it may be added to any layer of the image receiving element. The amount added is preferably $1\times10^{-8}$ to $5\times10^{-2}$ mol, more preferably $1\times10^{-7}$ to $5\times10^{-3}$ mol, per square meter of image receiving element.

The image receiving element, the photosensitive element and the processing composition of the present invention are described below.

The image receiving element in the present invention is applied to a support for carrying an image receiving layer containing silver precipitating nuclei, such as baryta paper, cellulose triacetate or a polyester compound. Such an image receiving element can be prepared by coating a support undercoated if necessary with a coating solution of an appropriate cellulose ester such as cellulose diacetate in which silver precipitating nuclei are dispersed. The resulting cellulose ester layer is subjected to alkaline hydrolysis to convert at least a part of the cellulose ester layer in the direction of the depth thereof to cellulose. In a particularly useful example, a layer containing silver precipitating nuclei and/or a lower cellulose ester layer thereunder which is not hydrolyzed, for example, an unhydrolyzed part of the cellulose ester layer containing cellulose diacetate, contains one or more mercapto compounds suitable for improving the color tone, the stability or other photographic properties of silver transferred images. Such a mercapto compound is utilized by diffusing from a position at which it is first placed until image formation. The image receiving elements of this type are described in U.S. Pat. No. 3,711,283.

Preferred examples of the mercapto compounds include compounds described in JP-A-49-120634, JP-B-56-44418, British Patent 1,276,961, JP-B-56-21140, JP-A-59-231537 and JP-A-60-122939.

Specific examples of the non-photosensitive silver precipitating nuclei include heavy metals such as iron, lead, zinc, nickel, cadmium, tin, chromium, copper and cobalt, and noble metals such as gold, silver (including fine colloidal silver), platinum and palladium. Further, there can also be preferably used sulfides and selenides of heavy metals and noble metals, for example, sulfides of copper, aluminum, zinc, cobalt, nickel, silver, lead, antimony, bismuth, cerium, magnesium, gold, platinum and palladium, and selenides of lead, zinc, antimony and nickel. Furthermore, silver halide grains previously fogged are reduced by development to metallic silver, which can also be preferably used as silver precipitating nuclei.

It is preferred that an acidic polymer layer for neutralization (alkali neutralization layer) is provided between the unsaponificated layer, that is, the unhydrolyzed part of the cellulose ester layer (timing layer) and the support. For example, polymer acids described in U.S. Pat. No. 3,594,164 are employed in the alkali neutralization layer used in the present invention. Preferred examples of the polymer acids include maleic anhydride copolymers (for example, styrene-maleic anhydride copolymers, methyl vinyl ether-maleic anhydride copolymers and ethylene-maleic anhydride copolymers), and (meth)acrylic (co)polymers (for example, acrylic acid-alkyl acrylate copolymers, acrylic acid-alkyl methacrylate copolymers, methacrylic acid-alkyl acrylate copolymers and methacrylic acid-alkyl methacrylate copolymers). In addition, polymers containing sulfonic acid such as the acetalized product of polyethylenesulfonic acid or benzaldehydesulfonic acid and polyvinyl alcohol are useful. Further, the neutralization layer may contain a mercapto compound used in the timing layer. For the purpose of improving the film physical properties, these polymer acids may be used in combination with hydrolyzable alkali non-permeable polymers (the above-mentioned cellulose esters are particularly preferred) or alkali permeable polymers.

It is further preferred that the image receiving sheet has an image stabilizing layer for improving the image keeping quality. As stabilizing agents used for this purpose, cationic polymer electrolytes are preferred. Particularly preferred examples of the cationic polymer electrolytes include aqueous latex dispersions described in JP-A-59-166940, U.S. Pat. No. 3,958,995, JP-A-55-142339, JP-A-54-126027, JP-A-54-155835 and JP-A-53-30328, polyvinyl pyridinium salts described in U.S. Pat. Nos. 2,548,564, 3,148,061 and 3,756,814, water-soluble quaternary ammonium salt polymers described in U.S. Pat. No. 3,709,690 and water-insoluble quaternary ammonium salt polymers described in U.S. Pat. No. 3,898,088. Cellulose acetate is preferably used as a binder for the image stabilizing layer, and particularly cellulose diacetate having an acetylation degree of 40 to 49% is preferred. This image stabilizing layer is preferably provided between the neutralization layer and the timing layer described above.

For the purposes of preventing the timing time from being prolonged by a change of the cellulose ester in storing for a long period of time and reducing the timing time, the timing layer may contain an acid polymer (for example, a copolymer of methyl vinyl ether and maleic anhydride or a copolymer of methyl vinyl ether and a half ester of maleic anhydride. In order to prevent light from entering the inside from a cross-sectional direction of the sheet (light piping), the timing layer or the neutralization layer may contain a white pigment (for example, titanium dioxide, silicon dioxide, kaolin, zinc dioxide or barium sulfate). Further, an intermediate layer is sometimes formed between the image receiving layer and the timing layer. As the intermediate layer, a hydrophilic polymer such as gum arabic, polyvinyl alcohol or polyacrylamide can be used.

Furthermore, it is preferred that the surface of the image receiving layer is provided with a separating layer to prevent a processing solution from adhering to the surface of the image receiving layer on separation after development of the processing solution. Preferred compounds used as such a separating layer include compounds described in U.S. Pat. Nos. 3,772,024 and 3,820,999 and British Patent 1,360,653, in addition to gum arabic, hydroxyethyl cellulose, carboxymethyl cellulose, polyvinyl alcohol, polyacrylamide and sodium alginate.

Preferred shading methods include a method of adding a shading agent (for example, carbon black or an organic black pigment) to paper of the support, and a method of applying the above-mentioned shading agent to the back surface of the support and further coating a white pigment (for example, titanium dioxide, silicon dioxide, kaolin, zinc dioxide or barium sulfate) thereon for whitening. A moisture absorbing agent such as glycerine or a film quality improving agent such as a polyethyl acrylate latex may be added to the support to improve the curl or the brittleness. It is further preferred that a protective layer is formed on the uppermost layer. A matte agent can be added to the protective layer to give the improved adhesive property and the writing property. Gelatin, cellulose esters and polyvinyl alcohol can be used as binders for the above-mentioned shading layer and protective layer.

In the present invention, a photosensitive element is preferably used in which a photosensitive silver halide emulsion layer is formed on one surface of a support, a polyethylene terephthalate film containing titanium dioxide or carbon black and having undercoat layers on both surfaces thereof, a protective layer is provided thereon, a carbon black layer is formed on the other surface, and a protective layer is provided thereon. In addition to the above-mentioned layer constitution, a photosensitive element is preferably used in which a titanium dioxide layer is formed on one surface of a support, a polyethylene terephthalate film containing titanium dioxide or carbon black and having undercoat layers on both surfaces thereof, a photosensitive silver halide emulsion layer is formed thereon, a protective layer is provided thereon, a carbon black layer is formed on the other surface, and a protective layer is provided thereon. In place of the above-mentioned carbon black or in addition thereto, a color dye can be used. When the polyethylene terephthalate film contains carbon black and/or the color dye, it is unnecessary to form the carbon black layer and/or the color dye layer on the other surface. Further, the above-mentioned titanium dioxide may be substituted by another white pigment. In addition to the above-mentioned polyester compound, paper laminated with polyethylene, baryta paper and cellulose triacetate are used as the support. The above-mentioned photosensitive silver halide emulsion layer, protective layer, carbon black layer, etc. usually contain a hydrophilic binder such as gelatin.

The silver halide contained in the photosensitive silver halide emulsion in the present invention may be any of silver iodobromide (containing pure silver bromide), silver chloroiodobromide (containing silver chlorobromide) and silver chloroiodide (containing silver chloride) each having a mean silver iodide content of 10 mol % or less. In particular, silver iodobromide, silver chloroiodobromide or silver chloroiodide having a silver iodide content of 2.0 to 10.0 mol % is preferred in that fluctuations in photographic properties are decreased in the aging storage of the processing solution. Although the mean grain size of silver halide emulsion grains (represented by the diameters of spheres equivalent to grains) is not particularly restricted, it is preferably 4 μm or less, more preferably 3 μm or less, particularly preferably 0.2 to 2 μm. The grain size distribution may be either narrow or wide. The silver halide grains contained in the silver halide emulsion may have a regular system crystal form such as a cubic form or an octahedral form, an irregular crystal form such as a spherical form or a tabular form, or a composite form of these crystal forms. In the present invention, the tabular silver halide grains are preferred to achieve the photosensitive element high in sensitivity and fast in transfer progress. The tabular grains are relatively large in surface area compared with other grains, and advantageous from the points of view of light absorption and the rate of dissolution. For the halogen composition distribution of the silver halide grains, grains having a so-called uniform type structure which are equivalent in composition even when any portion of the silver halide may be taken, grains having a so-called laminated type structure in which cores of the interiors of the silver halide grains are different from shells (a layer or plural layers) surrounding them in halogen composition, or grains having a structure in which the interiors or the surfaces of the grains have portions different in halogen composition in a non-layer form (when the portions different in composition exist on the surfaces of the grains, they are joined on edges, corners or faces of the grains) can be appropriately selected to use them. In order to obtain high sensitivity, it is advantageous to use either of the latter two type grains rather than the grains of the uniform type structure, and this is also preferred in terms of pressure resistance. When the silver halide grains have the structure as described above, boundaries of the portions different in halogen composition may be clear boundaries or unclear boundaries forming mixed crystals due to a difference in composition. Further, continuous changes in structure may be positively given. The silver halide grains of the present invention may be grains in which latent images are mainly formed on the surfaces or mainly formed in the interiors of the grains. Further, latent images may not be localized to either of them. In particular, grains are preferred in which latent images are formed at positions showing the maximum sensitivity under the following conditions (latent image position confirmation conditions: a silver halide emulsion is applied to polyethylene terephthalate so as to give a silver amount of 1 g/m$^2$, and a gelatin protective layer is provided thereon to form a sample, which is exposed, followed by development with a processing solution of 0.3 g/liter MAA-1+hypo at 20° C. for 20 minutes). The thickness of the silver halide emulsion layer is 0.5 to 8.0 μm, particularly 0.6 to 6.0 μm. The amount of silver halide grains coated is 0.1 to 3 g/m$^2$, preferably 0.2 to 1.5 g/m$^2$, as the amount of silver.

Various compounds can be added to the photosensitive silver halide emulsion layers for the purpose of preventing fogging during manufacturing stages, storage or photographic processing of the photosensitive materials or stabilizing photographic properties. As these compounds, there are preferably used well-known antifoggants and stabilizers such as azoles (for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, nitrobenzotriazoles and benzotriazoles), mercaptopyrimidines, mercaptotriazines, thioketo compounds, azaindenes (for example, triazaindenes, tetraazaindenes and pentaazaindenes), benzenesulfonic acid compounds, benzensulfinic acid compounds, benzenesulfonic acid amides and α-lipoic acid. Typical examples thereof include 1-phenyl-2-mercaptotetrazole, 4-hydroxy-6-methyl-1,3,3a,7-tetraazaindene, 2-mercaptobenzothiazole and 5-carboxybutyl-1,2-dithiolane.

More detailed examples thereof and methods for using them are described, for example, in U.S. Pat. No. 3,982,947 and JP-B-52-28660.

Further, spectral sensitizers may be added to the silver halide emulsion layers of the present invention. Preferred examples of the sensitizing dyes used include cyanine dyes, merocyanine dyes, complex cyanine dyes, complex merocyanine dyes, holopolar cyanine dyes, hemicyanine dyes, styryl dyes and hemioxanol dyes. Particularly useful dyes are ones belonging to cyanine dyes, merocyanine dyes and complex cyanine dyes. Furthermore, a plurality of spectral sensitizers can be used in combination as described in JP-A59-114533 and JP-A-61-163334.

Inorganic or organic hardeners may be added to the photosensitive elements of the present invention. Examples thereof include chromium salts (such as chrome alum and chromium acetate), aldehydes (such as formaldehyde, glyoxal and glutaraldehyde), N-methylol compounds (such as dimethylolurea and methylol dimethylhydantoin), dioxane derivatives (such as 2,3-dihydroxydioxane), active vinyl compounds (such as 1,3,5-triacryloyl-hexahydro-s-triazine) and mucohalogen acids (such as mucochloric acid and mucophenoxychloric acid). They may be used alone or in combination. Coating aids can be used in the silver halide emulsion layers and other hydrophilic colloidal layers of the photosensitive elements of the present invention. As the coating aids, compounds described in "Coating Aids" of *Research Disclosure*, vol. 176, No. 17643, page 26 (December, 1978) and JP-A-61-20035 can be used. For the purposes of increasing the sensitivity, enhancing the contrast or accelerating development, the silver halide emulsion layers and the other hydrophilic colloidal layers of the photosensitive elements of the present invention may contain various compounds, for example, polyalkylene oxides, or ether, ester and amine derivatives thereof, thioether compounds, thiomorpholine compounds, quaternary ammonium compounds, urethane derivatives, urea derivatives and imidazole derivatives. Compounds described in U.S. Pat. Nos. 2,400,532, 2,423,549, 2,716,062, 3,617,280, 3,772,021 and 3,808,003, etc. can be used as such compounds.

The silver halide emulsion layers and the other hydrophilic colloidal layers of the photosensitive elements of the present invention may contain dispersions of water-insoluble or slightly soluble synthetic polymers, for the purpose of improving dimension stability. For example, there can be used polymers comprising alkyl (meth)acrylates, alkoxyalkyl (meth)acrylates, glycidyl (meth)acrylamides, vinyl esters (such as vinyl acetate), acrylonitrile, olefines, styrene, etc. alone or in combination, or further in combination with acrylic acid, methacrylic acid, α,β-unsaturated dicarboxylic acids, hydroxyalkyl (meth)acrylates, styrenesulfonic acid, etc. as monomer components.

Protective layers may be formed on the silver halide emulsion layers used in the photosensitive elements of the present invention. The protective layers are formed of hydrophilic polymers such as gelatin, which may contain matting agents or lubricants such as polymethyl methacrylate latices and silica as described in JP-A-61-47946 and JP-A-61-75338. In the photosensitive elements of the present invention, the silver halide emulsion layers and the other hydrophilic colloidal layers may contain dyes or ultraviolet light absorbers for the purpose of filtering or irradiation prevention. In addition, the photosensitive elements of the present invention can contain antistatic agents, plasticizers and air antifoggants.

As the processing compositions used in the present invention, the processing compositions contain developing agents, solvents for silver halides and alkali agents. The photosensitive elements and/or the image receiving elements can also contain the developing agents and/or the solvents for silver halides, depending on their purpose. The developing agents used in the present invention are hydroxylamine compounds, particularly primary aliphatic N-substituted, secondary aliphatic N-substituted, aromatic N-substituted or β-hydroxylamine compounds. These are soluble in aqueous alkali solutions. Examples thereof include hydroxylamine, N-methylhydroxylamine, N-ethylhydroxylamine, compounds described in U.S. Pat. No. 2,857,276 and N-alkoxyalkyl substituted hydroxylamine compounds described in U.S. Pat. No. 3,293,034. Further, hydroxylamine derivatives having tetrahydrofurfuryl groups described in JP-A-49-88521 are also used. Furthermore, benzene derivatives in which at least two hydroxyl and/or amino groups are substituted at the ortho-positions of the benzene nucleus (for example, hydroquinone, amidol, Metol, glycine, p-aminophenol and pyrogallol) are also used. In addition, aminoreductons described in West German Patent Application (OLS) Nos. 2,009,054, 2,009,055 and 2,009,078, and heterocyclic aminoreductons described in U.S. Pat. No. 4,128,425 are also used. Moreover, tetraalkylreductic acids described in U.S. Pat. No. 3,615,440 can also be used. As the developing agents used in the present invention, it is particularly preferred to use the compounds represented by the above-mentioned formula (III).

The compounds represented by formula (III) are hereinafter described in detail.

The alkylene group represented by $L_3$ has the same meaning as defined for $L_1$ in formula (I). $L_3$ is preferably an alkylene group having 2 to 4 carbon atoms, and examples thereof include ethylene, trimethylene, tetramethylene and propylene. Ethylene and trimethylene are more preferred, and ethylene is particularly preferred.

The alkyl group represented by $R_{31}$ is a straight chain, branched or cyclic alkyl group, and the alkyl group has preferably 1 to 12 carbon atoms, more preferably 1 to 6 carbon atoms, particularly preferably 1 to 4 carbon atoms.The alkyl group represented by $R_{31}$ may have a substituent group, and as the substituent group, for example, the substituent group mentioned as that for $L_1$ in formula (I) can be applied. The preferred substituent group is an alkoxyl group. Examples of the alkyl groups represented by $R_{31}$ include methyl, ethyl, n-propyl, i-propyl, n-butyl, t-butyl, methoxyethyl and ethoxyethyl. Methyl and ethyl are more preferred, and methyl is particularly preferred.

The alkenyl group represented by $R_{31}$ is an alkenyl group having preferably 2 to 12 carbon atoms, more preferably 2 to 8 carbon atoms, particularly preferably 2 to 4 carbon atoms. The alkenyl group represented by $R_{31}$ may have a substituent group, and as the substituent group, for example, an alkyl group, etc., as well as the substituent group mentioned as that for $L_1$ in formula (I), can be applied. Examples of the alkenyl groups represented by $R_{31}$ include vinyl and allyl, and vinyl is more preferred. The aryl group represented by $R_{31}$has the same meaning as defined for the aryl groups represented by $R_1$ to $R_5$ in formula (II), and a phenyl group is preferred. As $R_{31}$, an alkyl group is preferred, an unsubstituted alkyl group and an alkoxy-substituted alkyl group are more preferred, an unsubstituted alkyl group is still more preferred, and methyl and ethyl are particularly preferred.

The alkyl group represented by $R_{32}$ has the same meaning as defined for the alkyl group represented by $R_{31}$. The alkenyl group represented by $R_{32}$ has the same meaning as defined for the alkenyl group represented by $R_{31}$. As $R_{32}$, a hydrogen atom or an alkoxy-substituted alkyl group is preferred, and an alkoxy-substituted alkyl group is more preferred. Specific examples of $R_{32}$ include a hydrogen atom, methyl, ethyl, methoxyethyl, ethoxyethyl and allyl.

Of the compounds represented by formula (III), a compound represented by the following formula (III-a) is preferred:

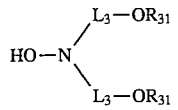

(III-a)

wherein $L_3$ and $R_{31}$ each has the same meaning as defined in formula (III), and preferred examples thereof are similar to those of formula (III).

Specific examples of the compounds represented by formula (III) are shown below, but the present invention is not limited thereto.

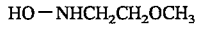

III-1

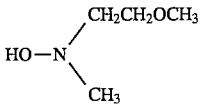

III-2

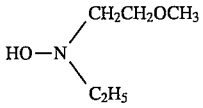

III-3

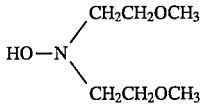

III-4

-continued

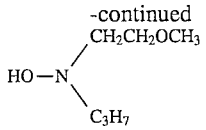
III-5

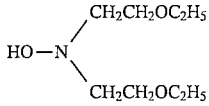
III-6

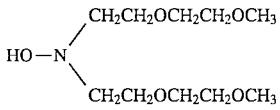
III-7

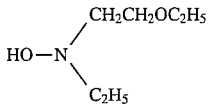
III-8

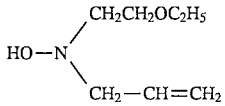
III-9

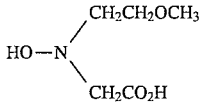
III-10

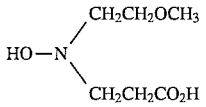
III-11

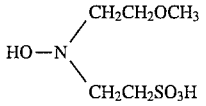
III-12

The amount of the compound of formula (III) of the present invention used is preferably $1\times10^{-3}$ to 2 mol, particularly preferably $5\times10^{-1}$ to 1 mol, per liter of processing solution.

The compounds represented by formula (III) of the present invention can be synthesized by known methods, for example, the method described in JP-B-42-2794.

As fixing agents (solvents for silver halides) used in the present invention, there can be used thioether compounds described in JP-A-4-328744, combined compounds of cyclic imides and nitrogen bases, compounds described in U.S. Pat. No. 2,857,274, and 1,1-bissulfonylalkane compounds and derivatives thereof, besides ordinary fixing agents (for example, uracil and derivatives thereof, thiosulfates and compounds described in U.S. Pat. No. 2,543,181).

The processing compositions (processing solutions) of the present invention contain alkalis, preferably hydroxides of alkali metals such as sodium hydroxide, potassium hydroxide and lithium hydroxide. When the processing composition is applied to the development thereof as a thin layer between the photosensitive element and the image receiving element superimposed on each other, it is preferred that the processing composition contains a polymer film forming agent, a thickening agent or a viscosity improver. Hydroxyethyl cellulose and sodium carboxymethyl cellulose are particularly preferred for this purpose, and added to the processing compositions at a concentration effective to give an appropriate viscosity by known techniques of the diffusion transfer photographic processes. The processing compositions may further contain other aids known in the silver salt diffusion transfer processes, such as antifoggants, toning agents and stabilizers. From the viewpoint of reducing the influence of fluctuations in photographic properties when the processing solutions are stored, it is preferred that iodide ions are added to the alkali processing solutions of the present invention.

The present invention will be described with reference to the following examples, but it is to be understood that the invention is not limited thereto.

EXAMPLE 1

1. Preparation of Image Receiving Sheet (1A)

The following layers were in turn formed on a support, paper laminated with polyethylene, to prepare an image receiving sheet (1A). The numerical values shown in brackets indicate the amount coated in g/m$^2$.

(1) Neutralization Layer

Cellulose acetate (acetylation degree: 55%) (6), methyl vinyl ether-maleic anhydride copolymer (4), Uvitex OB (trade name, Ciba-Geigy Aktiengesellschaft) (0.04) and 1-(4-hexylcarbamoylphenyl)-2,3-dihydroxyimidazole-2-thione (0.25)

(2) Image Stabilizing Layer

Cellulose acetate (acetylation degree: 46%) (4) and the following polymer A (2)

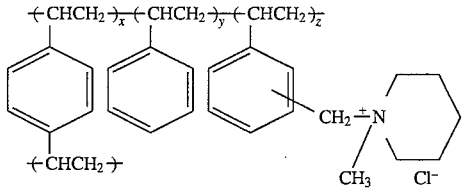
Polymer A x:y:z = 5:47.5:47.5

(3) Timing Layer

Cellulose acetate (acetylation degree: 55%) (8)

(4) Image Receiving Layer

Cellulose acetate (acetylation degree: 55%) (2), palladium sulfide ($7.5\times10^{-4}$) and 1-(4-hexylcarbamoylphenyl)-2,3-dihydroxyimidazole-2-thione ($1.0\times10^{-2}$)

(5) Saponification

Saponification was conducted from the surface using the mixed solution of 12 g of sodium hydroxide, 24 g of glycerin and 280 ml of methanol, followed by washing.

(6) Separating Layer

Butyl methacrylate-acrylic acid copolymer (molar ratio: 15:85) (0.1)

(7) Back Layer

The back surface of the above-described support was coated with a shading layer, a white layer and a protective layer.

(7-1) Shading Layer

Carbon black (4), gelatin (8) and spherical polyacrylate grains (mean size: 0.05 μm) (0.2)

(7-2) White Layer

Titanium dioxide (6) and gelatin (0.7)

(7-3) Protective Layer

Polymethyl methacrylate grains (mean size: 0.05 μm) (0.2) and gelatin (1.6)

2. Preparation of Photosensitive Element (1B)

A support (polyethylene terephthalate) was coated with the following respective layers to prepare photosensitive element (1B). The numerical values shown in brackets indicate the amount applied in g/m$^2$.

(1) Colloidal Silver Layer

Colloidal silver having a mean grain size of 0.01 μm (0.04) and gelatin (3.0)

(2) Photosensitive Layer

Silver iodobromide having a mean grain size of 1.8 μm and an aspect ratio of 5.0 (AgI content: 3.0 mol %) (0.60, converted to silver), 4-hydroxy-6-methyl-1,3,3a,7-tetraazaindene (0.012), the following sensitizing dye A ($4.1\times10^{-4}$), the following sensitizing dye B ($4.1\times10^{-4}$), the following sensitizing dye C ($1.4\times10^{-4}$) and gelatin (1.5)

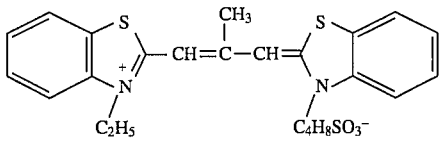

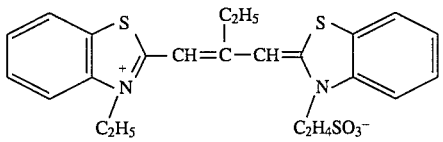

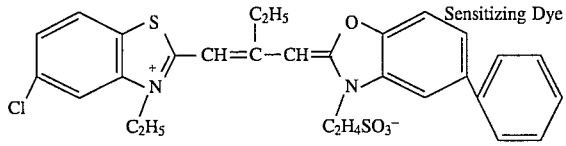

(3) Protective Layer

Gelatin (0.7) and polymethyl methacrylate grains (mean size: 4.7 μm) (0.1)

(4) Back Layer

The back surface of the above-described support was coated with a shading layer and a protective layer.

(4-1) Shading Layer

Carbon black (4.0) and gelatin (2.0)

(4-2) Protective Layer

Gelatin (0.7) and polymethyl methacrylate grains (mean size: 0.05 μm) (0.1)

3. Preparation of Processing Element

An alkali processing composition was prepared in a stream of nitrogen according to the following formulation. After preparation, a plurality of rupturable containers (pods) were charged with 0.7 g/pod of the processing composition to produce processing element (1).

| Composition | Amount Added |
|---|---|
| Titanium Dioxide | 5 g |
| Potassium Hydroxide | 280 g |
| Uracil | 56 g |
| 4-Methyluracil | 31 g |
| 5-Methyluracyl | 10 g |
| Tetrahydropyrimidinethione | 0.2 g |
| Zinc Nitrate-$9H_2O$ | 40 g |
| Triethanolamine | 6 g |
| Hydroxyethyl Cellulose | 45 g |
| Potassium Iodide | 0.5 g |
| 1-(3-Sulfophenyl)-2-mercaptoimidazole | 0.10 g |
| 2-(4-Sulfobutylthio)-5-mercapto-1,3,4-thiadiazole | 0.15 g |
| Example Compound (III) (described in Table 1) | 0.25 mol |
| Example Compound (II) (described in Table 1) | $5\times10^{-3}$ mol |
| Example Compound (I) (described in Table 1) | $5\times10^{-2}$ mol |
| 2,6-Di-tert-butylquinone | 0.002 g |
| $H_2O$ | 1300 ml |

Then, processing elements (2) to (25) were produced in the same manner as with (1), with the exception that the compounds represented by formula (I) among example compounds (I), (II) and (III) in the processing solution produced by use of processing element (1) were changed as shown in Table 1.

4. Development Processing

For a sample in which the above-mentioned photosensitive element (1B) exposed through an optical wedge at 16 luxes for 0.01 second was combined with image receiving element (1A) and each of processing compositions (1) to (25), development processing was conducted so as to give a liquid thickness of 38 μm at 25° C., followed by separation after 15 seconds. An entire black transferred image and a transferred image for sensitometry obtained on the receiving sheet was observed. The exposures giving the maximum density and a density of 0.3 were measured. Then, the receiving sheet on which the transferred image was obtained was stored at 25° C. at 90% RH for 1 week, and a change in density at an exposure giving a density of 0.3 before storage was measured. Results obtained are shown in Table 1.

TABLE 1

| No. | Example Compound (I) | Example Compound (II) | Example Compound (III) | Maximum Density | Image Storage (D = 0.3) | Remarks |
|---|---|---|---|---|---|---|
| 1 | None | None | III-4 | 1.85 | −0.03 | Comparison |
| 2 | None | II-2 | III-4 | 2.02 | −0.08 | Comparison |
| 3 | Comparison (1) | II-2 | III-4 | 2.04 | −0.09 | Comparison |
| 4 | Comparison (2) | II-2 | III-4 | 2.01 | −0.08 | Comparison |
| 5 | Comparison (3) | II-2 | III-4 | 2.05 | −0.08 | Comparison |
| 6 | Comparison (4) | II-2 | III-4 | 2.00 | −0.08 | Comparison |
| 7 | I-2 | II-2 | III-4 | 2.01 | −0.04 | Invention |
| 8 | I-4 | II-2 | III-4 | 2.05 | −0.01 | Invention |
| 9 | I-5 | II-2 | III-4 | 2.04 | 0.00 | Invention |
| 10 | I-6 | II-2 | III-4 | 2.05 | −0.01 | Invention |
| 11 | I-7 | II-2 | III-4 | 2.01 | −0.04 | Invention |
| 12 | I-9 | II-2 | III-4 | 2.00 | −0.03 | Invention |
| 13 | I-11 | II-2 | III-4 | 2.02 | −0.03 | Invention |
| 14 | I-14 | II-2 | III-4 | 2.01 | −0.05 | Invention |
| 15 | I-18 | II-2 | III-4 | 2.02 | −0.03 | Invention |
| 16 | I-20 | II-2 | III-4 | 2.01 | −0.04 | Invention |
| 17 | I-21 | II-2 | III-4 | 2.00 | −0.04 | Invention |
| 18 | I-24 | II-2 | III-4 | 2.04 | −0.04 | Invention |

TABLE 1-continued

| No. | Example Compound (I) | Example Compound (II) | Example Compound (III) | Maximum Density | Image Storage (D = 0.3) | Remarks |
|---|---|---|---|---|---|---|
| 19 | I-30 | II-2 | III-4 | 2.04 | −0.01 | Invention |
| 20 | I-31 | II-2 | III-4 | 2.05 | 0.00 | Invention |
| 21 | I-32 | II-2 | III-4 | 2.04 | −0.01 | Invention |
| 22 | I-37 | II-2 | III-4 | 2.03 | 0.00 | Invention |
| 23 | I-43 | II-2 | III-4 | 2.01 | −0.03 | Invention |
| 24 | I-44 | II-2 | III-4 | 2.01 | −0.04 | Invention |
| 25 | I-61 | II-2 | III-4 | 2.00 | −0.04 | Invention |

As apparent from Table 1, addition of compound (II-2) represented by formula (II) of the present invention to the processing elements accelerated transfer reaction, which caused an increase in the maximum density, but deteriorated the stability of the images when the transferred images were stored. In contrast, addition of the compounds represented by formula (I) of the present invention recovered the image stability to a level equivalent to or higher than the level obtained when the compound represented by formula (II) was not added, while keeping the accelerated level with no substantial decrease in the maximum density. In particular, the compounds represented by formula (I-a) raised the image keeping quality to a higher level to obtain better results. In contrast, the hydroxylamine compounds not corresponding to formula (I) of the present invention did not improve the image keeping quality at all.

Comparison (1): Hydroxylamine Sulfate

Comparison (2): N,N-Diethylhydroxylamine

Comparison (3): N-Ethylhydroxylamine

Comparison (4): N-(2-Carboxyethyl)-N-(2-hydroxyethyl) hydroxylamine

The amount of the compounds of comparisons (1) to (4) added was $5\times10^{-2}$ mol, as with the compounds represented by formula (I).

EXAMPLE 2

Processing elements (26) to (44) were produced in the same manner as with Example 1, with the exception that the compound represented by formula (II) of the present invention in the processing solutions produced in Example 1 was changed as shown in Table 2. After processing similar to that of Example 1, the maximum density and the image stability were examined for the resulting transferred images. Results obtained are shown in Table 2.

TABLE 2

| No. | Example Compound (I) | Example Compound (II) | Example Compound (III) | Maximum Density | Image Storage (D = 0.3) | Remarks |
|---|---|---|---|---|---|---|
| 26 | None | None | III-4 | 1.85 | −0.03 | Comparison |
| 27 | None | II-1 | III-4 | 2.01 | −0.08 | Comparison |
| 28 | I-5 | II-1 | III-4 | 2.03 | −0.01 | Invention |
| 29 | I-20 | II-1 | III-4 | 2.02 | −0.01 | Invention |
| 30 | None | II-2 | III-4 | 2.02 | −0.08 | Comparison |
| 31 | I-5 | II-2 | III-4 | 2.04 | 0.00 | Invention |
| 32 | I-20 | II-2 | III-4 | 2.04 | −0.01 | Invention |
| 33 | None | II-3 | III-4 | 2.01 | −0.07 | Comparison |
| 34 | I-5 | II-3 | III-4 | 2.02 | 0.00 | Invention |
| 35 | I-20 | II-3 | III-4 | 2.02 | −0.01 | Invention |
| 36 | None | II-5 | III-4 | 2.01 | −0.08 | Comparison |
| 37 | I-5 | II-5 | III-4 | 2.03 | −0.01 | Invention |
| 38 | I-20 | II-5 | III-4 | 2.02 | −0.01 | Invention |
| 39 | None | II-8 | III-4 | 2.04 | −0.09 | Comparison |
| 40 | I-5 | II-8 | III-4 | 2.02 | 0.00 | Invention |
| 41 | I-20 | II-8 | III-4 | 2.01 | −0.01 | Invention |
| 42 | None | II-15 | III-4 | 2.03 | −0.07 | Comparison |
| 43 | I-5 | II-15 | III-4 | 2.02 | 0.00 | Invention |
| 44 | I-20 | II-15 | III-4 | 2.02 | −0.01 | Invention |

As apparent from Table 2, all the compounds represented by formula (11) of the present invention raised the maximum density, but deteriorated the image stability compared with the case that the compounds were not added. In contrast, addition of compound (I-5) or (I-20) represented by formula (I) of the present invention recovered the image stability to a level equivalent to or higher than the level obtained when the compound represented by formula (II) was not added, but results different in the level of the image keeping quality were obtained depending on the kind of compound represented by formula (II).

EXAMPLE 3

Processing elements (45) to (62) were produced in the same manner as with Example 1, with the exception that the compound represented by formula (III) of the present invention in the processing solutions produced in Example 1 was changed as shown in Table 3. After processing similar to that of Example 1, the maximum density and the image stability were examined for the resulting transferred images. Results obtained are shown in Table 3.

TABLE 3

| No. | Example Compound (I) | Example Compound (II) | Example Compound (III) | Maximum Density | Image Storage (D = 0.3) | Remarks |
|---|---|---|---|---|---|---|
| 45 | None | II-2 | III-4 | 2.02 | −0.08 | Comparison |
| 46 | I-5 | II-2 | III-4 | 2.04 | 0.00 | Invention |
| 47 | I-20 | II-2 | III-4 | 2.04 | −0.01 | Invention |
| 48 | None | II-2 | III-1 | 2.01 | −0.07 | Comparison |
| 49 | I-5 | II-2 | III-1 | 2.04 | −0.01 | Invention |
| 50 | I-20 | II-2 | III-1 | 2.03 | −0.01 | Invention |
| 51 | None | II-2 | III-3 | 2.03 | −0.08 | Comparison |
| 52 | I-5 | II-2 | III-3 | 2.03 | 0.00 | Invention |
| 53 | I-20 | II-2 | III-3 | 2.02 | −0.01 | Invention |
| 54 | None | II-2 | III-6 | 2.02 | −0.08 | Comparison |
| 55 | I-5 | II-2 | III-6 | 2.04 | 0.00 | Invention |
| 56 | I-20 | II-2 | III-6 | 2.03 | −0.01 | Invention |
| 57 | None | II-2 | III-8 | 2.01 | −0.09 | Comparison |
| 58 | I-5 | II-2 | III-8 | 2.02 | −0.01 | Invention |
| 59 | I-20 | II-2 | III-8 | 2.01 | −0.01 | Invention |
| 60 | None | II-2 | III-10 | 2.02 | −0.08 | Comparison |
| 61 | I-5 | II-2 | III-10 | 2.02 | 0.00 | Invention |
| 62 | I-20 | II-2 | III-10 | 2.01 | −0.01 | Invention |

As apparent from Table 3, when the compounds represented by formula (III) of the present invention were added as the developing agents, and the compound represented by formula (II) was further added, the maximum density was increased, but the image keeping quality was deteriorated compared with the case that compound (II-2) represented by formula (II) were not added. In contrast, addition of compound (I-5) or (I-20) represented by formula (I) recovered the image keeping quality to a level equivalent to or higher than the level obtained when the compound represented by formula (II) was not added, while keeping the maximum density high, giving good results.

EXAMPLE 4

Processing elements (63) to (67) were produced in the same manner as with Example 1, with the exception that the amount of compound (I-5) added in processing solution (8) produced in Example 1 was changed as shown in Table 4. After processing similar to that of Example 1, the maximum density and the image stability were examined for the resulting transferred images. The minimum density of the resulting transferred images was further measured, and results obtained are shown in Table 4.

TABLE 4

| No. | Example Compound I-5 Amount Added mol/liter | Maximum Density | Image Storage (D = 0.3) | Minimum Density | Remarks |
|---|---|---|---|---|---|
| 63 | None | 2.02 | −0.08 | 0.12 | Comparison |
| 64 | $1.0 \times 10^{-5}$ | 2.03 | −0.03 | 0.12 | Invention |
| 65 | $5.0 \times 10^{-2}$ | 2.04 | 0.00 | 0.12 | Invention |
| 66 | $1.0 \times 10^{-1}$ | 2.06 | 0.00 | 0.14 | Invention |
| 67 | $2.0 \times 10^{-1}$ | 2.09 | 0.00 | 0.18 | Invention |

As apparent from Table 4, compound (I-5) of the present invention increased the effect of image keeping quality in an amount added of $1\times10^{-5}$ mol or more per liter of processing solution, but increased the minimum density (stain) of the transferred images in an amount added of $2\times10^{-1}$ mol or more per liter of processing solution, which introduced a new problem. This result revealed that the amount added ranging from $1\times10^{-5}$ mol to $1\times10^{-1}$ mol per liter of processing solution was particularly preferred.

EXAMPLE 5

Image receiving element (2A) was produced in the same manner as with image receiving element (1A) produced in Example 1, with the exception that compound (I-32) of the present invention was added to the neutralization timing layer of the image receiving element (1A) in an amount added of $1\times10^{-3}$ mol per square meter of the image receiving element. These image receiving elements (1A) and (2A) each was combined with photosensitive element (1B) and processing element (1) or (2), and processed in the same manner as with Example 1. The maximum density and the image stability were examined for the resulting transferred images, and results obtained are shown in Table 5.

TABLE 5

| No. | Processing Element | Image Receiving Element | Maximum Density | Image Storage (D = 0.3) | Remarks |
|---|---|---|---|---|---|
| 68 | 1 | 1A | 1.85 | −0.03 | Comparison |
| 69 | 1 | 2A | 1.86 | −0.02 | Comparison |
| 70 | 2 | 1A | 2.01 | −0.08 | Comparison |
| 71 | 2 | 2A | 2.03 | −0.02 | Invention |

As apparent from Table 5, even when compound (I-32) represented by formula (I) of the present invention was added to the image receiving element and compound (II-2) represented by formula (II) was added to the processing element, followed by processing, the maximum density was increased and the image keeping quality of the transferred image was excellent, giving preferred results.

When the silver salt diffusion transfer process is conducted in the presence of the compound represented by formula (I) and the compound represented by formula (II), preferred results are obtained that the maximum density is high and the image keeping quality of the transferred image is excellent.

While the invention has been described in detail and with reference to specific embodiments thereof, it will be apparent to one skilled in the art that various changes and modifications can be made therein without departing from the spirit and scope thereof.

What is claimed is:

1. An image formation method by silver salt diffusion transfer comprising:

subjecting a photosensitive element containing at least one photosensitive silver halide emulsion layer to image exposure, then developing the photosensitive element by use of an alkali processing composition containing a solvent for a silver halide to turn at least a part of unexposed silver halide of said photosensitive silver halide emulsion layer into a transferable silver complex salt, transferring at least a part of said transferable complex salt to a silver precipitating nucleus-containing image receiving layer to form an image on said silver precipitating nucleus-containing image receiving layer, and separating said silver precipitating nucleus-containing image receiving layer from said photosensitive element after image formation to obtain the image, wherein said image is formed in the presence of at least one compound represented by the following formula (I-a) and at least one compound represented by the following formula (II):

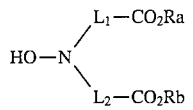

(I-a)

wherein Ra and Rb each represents a hydrogen atom, an alkyl group or a cation; $L_1$ and $L_2$ each represents an alkylene group;

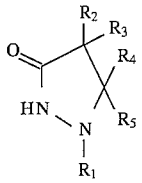

(II)

wherein $R_l$ represents an aryl group; and $R_2$, $R_3$, $R_4$ and $R_5$ each represents a hydrogen atom, an alkyl group, an aryl group, an alkoxyl group or an aryloxy group.

2. The image formation method according to claim 1, wherein said at least one compound represented by formula (I-a) is added to the alkali processing composition in an amount of $5\times10^{-5}$ mol to 1 mol per liter of the alkali processing composition, and said at least one compound represented by formula (II) is added to the alkali processing composition in an amount of $5\times10^{-6}$ mol to $1\times10^{-1}$ mol per liter of the alkali processing composition.

* * * * *